United States Patent [19]

Wilkinson

[11] Patent Number: 4,478,233

[45] Date of Patent: Oct. 23, 1984

[54] DENTAL HOLDER

[76] Inventor: David E. Wilkinson, 38338 Glenview Dr., Fremont, Calif. 94536

[21] Appl. No.: 460,156

[22] Filed: Apr. 25, 1983

[51] Int. Cl.[3] ..... A45D 44/18
[52] U.S. Cl. ..... 132/84 D
[58] Field of Search ..... 132/84 B, 84 R

[56] References Cited

U.S. PATENT DOCUMENTS 1,501,656 7/1924 Gilda ..... 132/84 D
2,259,848 10/1941 Ward ..... 132/84 D

FOREIGN PATENT DOCUMENTS 676939 6/1939 Fed. Rep. of Germany .... 132/84 R

*Primary Examiner*—Gregory E. McNeill
*Attorney, Agent, or Firm*—T. R. Zegree

[57] ABSTRACT

A durable dental holder for a toothbrush and its combination with means for supporting a tube of toothpaste is described. The holder comprises a pivotably mounted flap having an opening for the passage of a toothbrush handle and a pair of longitudinal notches in the lower portion of its front wall for a gripping engagement with a flexible tube of toothpaste.

10 Claims, 7 Drawing Figures

DENTAL HOLDER

BACKGROUND OF THE INVENTION

This invention relates to an improved dental holder. More particularly, the invention relates to a holder, the construction of which is adapted to support a toothbrush and which also may support a tube of toothpaste.

Various types of toothbrush holders or combined toothbrush and toothpaste tube holders have been described in the patent literature. For example, U.S. Pat. No. 1,310,089 to Rhodes describes a cruciform holder having a pair of horizontal arms, each ending with a circular loop, and a casing for covering a toothbrush. U.S. Pat. No. 1,335,250 to Lippert discloses a holder formed of a strand of wire, a portion of which is bent to form a loop, another portion being twisted to form a pair of parallel wires comprising a lateral slot. U.S. Pat. No. 1,652,862 covers a horizontal plate-shaped device, the lower portion of which is provided with a transverse slot having a clip inserted therein. U.S. Pat. No. 1,695,185 to Gale discloses a holder made of a single wire, the upper ends of which are bent back upon themselves to form split eyes and its lower ends are turned to form a horizontal V-shaped recess. U.S. Pat. No. 2,472,058 to Artley describes a holder comprising a pair of spring hooks for its attachment to the edge portion of a shelf, a lateral curved end portion and another pair of hooks extending downwardly therefrom. U.S. Pat. No. 2,522,470 to Tideman shows a tubular holder having a plurality of spaced slots and adapted to support toothbrushes in either vertical or horizontal position. U.S. Pat. No. 2,957,584 to Jenkins describes a disposable folding collapsible rack made of paper tag stock having a number of slugs which have to be pushed out to provide openings for toothbrushes. U.S. Pat. No. 3,085,716 to Trattler discloses a combination tube holder constructed of wire and provided with a winding key for dispensing toothpaste.

While the aforementioned patents disclose the general concept of holding devices having different forms for toothbrushes alone or in combination with collapsible tubes of toothpaste, the holder of this invention provides a new approach to the structure of such device which offers certain advantages over the prior art devices.

OBJECTS OF THE INVENTION

In view of the foregoing, it is the principal object of this invention to provide a lightweight, sturdy holder having a pivotable flap adapted for supporting a toothbrush.

Another object of the invention is to provide a durable holding device for a toothbrush which includes a means for supporting a toothpaste tube.

A further object of the present invention is to provide one-piece dental holder combination for a toothbrush and a toothpaste tube which can readily be included into a package containing commercially available toothpaste.

Still another object of the invention is to provide a small and compact dental holder of the character described herein which can easily be manufactured in volume quantities at a low cost from readily available materials.

BRIEF SUMMARY OF THE INVENTION

These and other objects of the present invention will become more fully apparent from the following description taken in conjunction with the accompanying drawings.

In accordance with the invention, there is provided a dental holder comprising a rear wall, a midsection and a front wall having an upper portion and a lower portion. The rear wall is adapted to bear against a flat support surface, such as a bathroom wall, for affixing thereto. The midsection connects the rear wall to the front wall and is designed to suspend the holder on a bathroom fixture, such as a towel rack. The front wall is provided with an aperture and a pivotably mounted flap comprising an opening adapted for passageway and support of a toothbrush. The lower portion of the front wall may be provided with a pair of notches spaced apart in parallel relationship and adapted for gripping and retaining engagement with a bendable base of a toothpaste tube.

BRIEF DESCRIPTION OF THE DRAWINGS

The invention will now be more fully described with reference to the accompanying drawings wherein like reference characters designate corresponding elements throughout the views thereof.

DETAILED DESCRIPTION OF THE INVENTION

Figure 1:
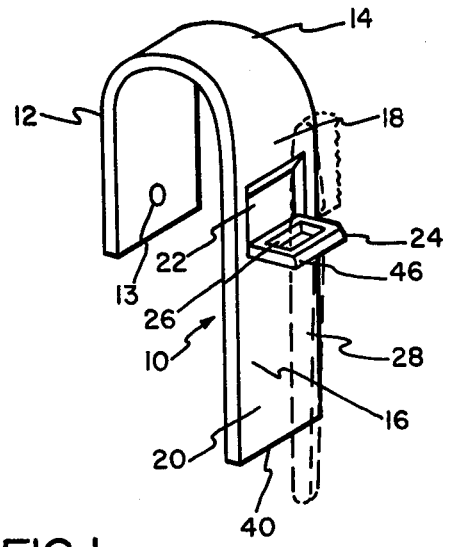
FIG. 1 is a perspective view of the dental holder of this invention in operative position with a suspended toothbrush shown in dotted lines.
Figure 3:
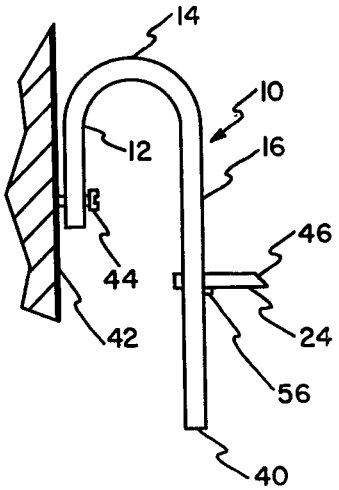
FIG. 3 is a side elevational view of the dental holder shown in FIG. 1 affixed to an upright wall.

Referring now to the drawings, a substantially rigid but slightly resilient unitary dental holder 10, as illustrated in FIGS. 1 and 3, comprises a relatively short, flat, upright rear wall 12 which may be provided with a centrally disposed hole 13 adapted for passage of a suitable fastener 44, such as a nail, a screw or the like for affixing the holder to a preferably flat support surface, such as a bathroom wall 42. The upper area of rear wall 12 connects to midsection 14 having outwardly curved, substantially arcuate configuration which, in turn, connects to the upper area of a generally upright front wall 16 which consists of an upper portion 18 and a lower portion 20. The front wall 16 which is longer than rear wall 12, preferably about twice the length of rear wall 12, extends downwardly in substantially parallel relation to rear wall 12. Thus the rear wall 12, the midsection 14 and the front wall 16 form a single, integral unit having substantially the same width and thickness. In an alternate form of holder 10, midsection 14 may be flat, disposed horizontally and connecting with rear wall 12 and front wall 16 at substantially right angles.

Figure 5:
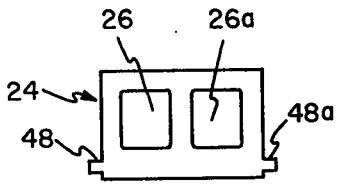
FIG. 5 is a top plan view of the flap provided with a pair of openings for two toothbrushes and a pair of lateral lugs.
Figure 6:
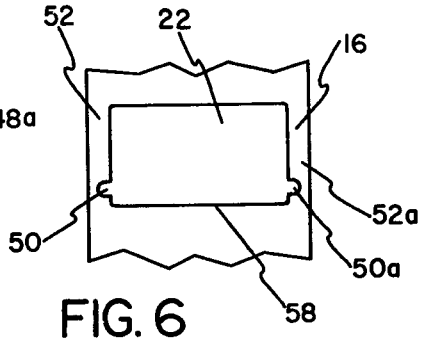
FIG. 6 is a fragmentary back elevational view of the front wall showing an aperture therein and a pair of recesses adapted to receive the two lugs.

As shown in FIG. 1, front wall 16 is provided with an aperture 22 of generally rectangular configuration and with a rectangularly shaped flap 24 which is pivotably mounted in two inner upright walls 52 and 52*a* surrounding the aperture 22. Flap 24 includes at least one opening 26 therein preferably of a substantially rectangular configuration which is specifically adapted for removable insertion of a handle of a toothbrush 28 which is satisfactorily supported on the upper surface of the open flap 24 by its bristles. If desired, flap 24 may be provided with two or more openings 26 and 26*a*, preferably of the same size, as shown in FIG. 5, each opening being proportioned to support an individual toothbrush. Moreover, flap 24 is provided with a pair of short lugs 48 and 48*a*, each projecting transversely and outwardly from each upright outer wall of flap 24, the lugs being adapted for removable "snap-in" mounting in a pair of small recesses 50 and 50*a*, the size of which is very slightly larger than that of the lugs. Each recess 50 and 50*a* is formed in each upright inner wall 52 and 52*a* of front wall 16 adjacent the lower end of aperture 22, as illustrated in FIG. 6. Thus the pivotably disposed flap 24 fits and closes aperture 22 when in its upright position as its outer perimeter substantially follows the contour of aperture 22. Flap 24 is easily swingable outwardly to its operative position at an angle between about 80° and 100° in relation to vertical plane, preferably at a substantially right angle, as shown in FIGS. 1 and 3. To support and maintain flap 24 in a substantially horizontal plane when in open position, a small projecting member 56 may be provided on the outer surface of front wall 16 slightly under the flap. However, flap 24 is satisfactorily supported in its open operative position without member 56 by edge 58 which constitutes the lower transverse portion of aperture 22 in front wall 16. It will be appreciated that the foldable flap 24 mounted snugly but removably in recesses 50 and 50*a* of the cut-out aperture 22 for supporting a toothbrush constitutes an essential feature of the dental holder according to the present invention.

Figure 2:
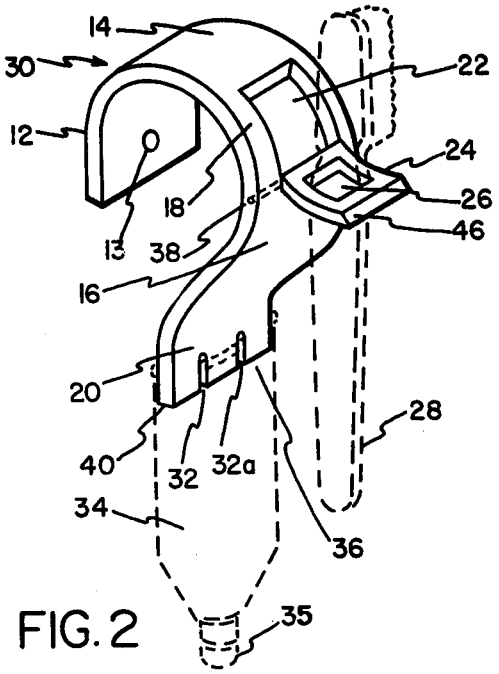
FIG. 2 is a perspective view of a modified form of the combined dental holder likewise in operative position wherein a toothbrush and a toothpaste tube are shown in dotted lines.
Figure 7:
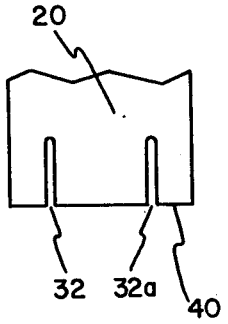
FIG. 7 is a fragmentary front elevational view of the lower portion of the front wall showing a pair of notches for receiving the base of a toothpaste tube.

In accordance with another important feature of this invention, the toothbrush holder may be combined with means for holding a flexible tube 34 of toothpaste. Such means, as shown in FIG. 2 and in more detail in FIG. 7 is composed of a pair of longitudinal, relatively narrow notches 32 and 32*a* provided in the lower portion 20 of front wall 16. Such notches are spaced apart in parallel relationship for gripping and retaining engagement with such a tube when the bendable base thereof is inserted therebetween in its inverted position. Both notches 32 and 32*a* extend downwardly in the lower portion 20 of front wall 16 ending at the level of its horizontal bottom edge 40. To mount a collapsible tube 34 of toothpaste in its inverted position, as illustrated in FIG. 2, its base portion 36 is inserted transversely of front wall 16 between the two notches 32 and 32*a* so that it is gripped, suspended and held firmly in the notched portion of front wall 16. To dispense the paste, the user unscrews cap 35 of tube 34 and squeezes the desired quantity of the paste on the bristle portion of a toothbrush in the usual manner. It will be understood that the tube of toothpaste may remain attached to the holder until the contents thereof have been exhausted, at which time it is easily removed and replaced by a new tube.

Figure 4:
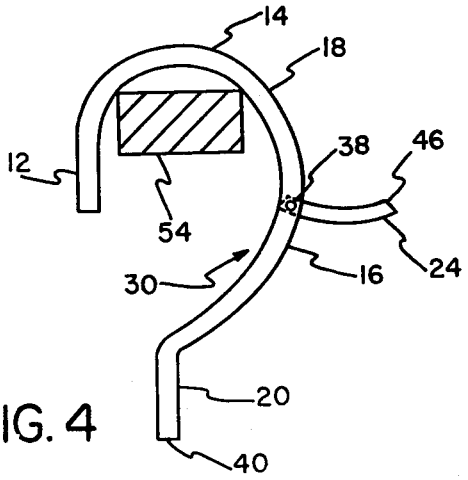
FIG. 4 is a side elevational view of the dental holder of FIG. 2 positioned on a bathroom fixture.

In another embodiment of the present invention, as illustrated in FIGS. 2 and 4, the combined dental holder 30 for a toothbrush and a flexible tube of toothpaste comprises a few modifications, the description of which follows.

In accordance with this embodiment, the rear wall 12 is upright and flat similarly to that shown in FIG. 1 and the midsection 14 is likewise of curved configuration. However, the front wall 16 comprises a curved, relatively long upper portion 18 in the form of an inverted C forming a smooth surface with midsection 14 and a short, upright lower end portion 20 which is provided with a pair of vertical notches 32 and 32*a* similar to those described hereinabove. To insure an easy insertion or removal of a toothpaste tube, the vertically disposed rear wall 12 and lower portion 20 of front wall 16 are spaced apart a short distance in a plane generally parallel with each other. In addition, the contour of flap 24 is curved in the same manner as the contour of the adjacent areas of upper portion 18 of front wall 16 so that, when in closed position, flap 24 and such adjacent areas form together a substantially continuous surface of curved configuration. Flap 24 may be hinged on a thin, rigid, transverse pin 38 positioned across the width of holder 30 in the area adjacent the lower part of aperture 22 and passing in a tight fit through a narrow passageway formed through the thickness of front wall 16 and of flap 24. Optionally, two short pins of about the same length may be provided, each pin extending transversely from the edges of front wall 16 inwardly into flap 24. To insure a snug fit with aperture 22, the upper edge 46 of flap 24 may be beveled inwardly to an angle complementing that of the upper front wall edge adjacent the aperture 22.

As shown in FIG. 4, holder 30 may be freely suspended on a bathroom fixture 54 illustrated in a cross-sectional view, such as a towel rack, a rod-like portion of a soap dish or the like. The holder may be fabricated from a substantially rigid but somewhat resilient material, such as acrylic sheet or other thermoplastic sheets which, when heated, become pliable or from any suitable powdered resin employed in the well known molding procedures. Other materials, such as metal or wood, may likewise be employed in the manufacture of the holder of this invention.

It will be apparent from the foregoing description that I have devised an improved lightweight durable dental holder, the walls of which are of substantially uniform width and thickness and which is useful for suspending and supporting a toothbrush and, optionally, a flexible tube of toothpaste. The holder is characterized by a combination of novel features which are required for its basic function. Due to its small size, the holder may be conveniently packaged together with a tube of toothpaste. It can easily be installed in a position of use by affixing to a bathroom wall or simply by freely suspending on a rod-like portion of a bathroom fixture. Due to simplicity of its construction, the holder of this invention may be manufactured inexpensively in a large volume.

It will be understood that various modifications in the form or in the constructional details of my invention as herein described may be made without departing from the spirit thereof or the scope of the claims which follow.

I claim:

1. A dental holder comprising a rear wall, a midsection and a front wall having an upper portion and a lower portion, said rear wall being adapted to bear against a flat support surface for affixing thereto; said midsection connecting said rear wall to said front wall; said front wall being provided with an aperture and a pivotably mounted flap comprising an opening adapted for passageway and support of a toothbrush.

2. The holder of claim 1 wherein the lower portion of said front wall is provided with a pair of notches spaced apart in parallel relation and adapted for gripping and retaining engagement with a bendable base of a toothpaste tube.

3. The holder of claim 2 wherein said rear wall is flat and provided with a centrally disposed hole for passage of a fastener.

4. The holder of claim 2 wherein said midsection is of curved configuration.

5. The holder of claim 2 wherein said front wall is generally upright.

6. The holder of claim 2 wherein the upper portion of said front wall is curved and the lower end portion of said front wall is upright.

7. The holder of claim 2 wherein said flap includes a pair of transversely projecting lugs, each of said lugs being adapted for snug mounting of said flap in a recess provided in an upright inner wall adjacent the lower end of said aperture.

8. The holder of claim 2 wherein said flap is hinged on a transverse pin positioned across the width of said holder adjacent the lower area of said aperture.

9. The holder of claim 2 wherein said flap and said opening therein are of substantially rectangular configuration and said flap projects in a substantially horizontal plane when in open position.

10. The holder of claim 2 wherein said notches extend downwardly to horizontal edge of the lower end portion of said front wall.

* * * * *